US007390267B2

(12) United States Patent
Grace

(10) Patent No.: US 7,390,267 B2
(45) **Date of Patent: *Jun. 24, 2008**

(54) GOLF CLUB HEAD

(75) Inventor: Robert M. Grace, St. Pete Beach, FL (US)

(73) Assignee: MacGregor Golf Company, Albany, GA (US)

( * ) Notice: Subject to any disclaimer, the term of this patent is extended or adjusted under 35 U.S.C. 154(b) by 194 days.

This patent is subject to a terminal disclaimer.

(21) Appl. No.: 11/061,540

(22) Filed: Feb. 18, 2005

(65) Prior Publication Data

US 2006/0189408 A1 Aug. 24, 2006

(51) Int. Cl.
*A63B 69/36* (2006.01)
*A63B 53/04* (2006.01)

(52) U.S. Cl. ..... 473/251; 473/334; 473/340; 473/349

(58) Field of Classification Search ..... 473/324–350, 473/219–256
See application file for complete search history.

(56) References Cited

U.S. PATENT DOCUMENTS

| | | | | | |
|---|---|---|---|---|---|
| 3,841,640 | A * | 10/1974 | Gaulocher | 473/249 |
| 4,693,478 | A * | 9/1987 | Long | 473/251 |
| 4,898,387 | A * | 2/1990 | Finney | 473/341 |
| 5,058,895 | A | 10/1991 | Igarashi | |
| 5,080,365 | A * | 1/1992 | Winchell | 473/255 |
| 5,100,146 | A | 3/1992 | Antonious | |
| D360,009 | S | 7/1995 | Grace | |
| 5,700,207 | A | 12/1997 | Guthrie et al. | |
| 5,830,078 | A * | 11/1998 | McMahan | 473/252 |
| 6,102,814 | A | 8/2000 | Grace et al. | |
| D438,273 | S | 2/2001 | Sizemore, Jr. | |
| D439,295 | S | 3/2001 | Sizemore, Jr. | |
| 6,270,422 | B1 | 8/2001 | Fisher | |
| D455,467 | S | 4/2002 | Shenoha | |
| D486,541 | S | 2/2004 | Bettinardi | |
| D488,200 | S * | 4/2004 | Olsavsky et al. | D21/743 |
| 6,796,911 | B2 * | 9/2004 | Grace | 473/251 |
| D502,233 | S * | 2/2005 | Grace | D21/736 |
| D502,234 | S * | 2/2005 | Grace | D21/736 |
| D502,236 | S * | 2/2005 | Grace | D21/743 |
| 6,896,625 | B2 * | 5/2005 | Grace | 473/251 |
| 6,926,615 | B1 * | 8/2005 | Souza et al. | 473/251 |
| 6,929,559 | B1 * | 8/2005 | Grace | 473/251 |
| 6,929,564 | B2 * | 8/2005 | Olsavsky et al. | 473/340 |
| 6,974,394 | B1 * | 12/2005 | Tang et al. | 473/335 |
| 7,048,639 | B2 * | 5/2006 | Grace | 473/251 |
| 2003/0144077 | A1 * | 7/2003 | Cullen | 473/340 |

* cited by examiner

*Primary Examiner*—Sebastiano Passaniti
(74) *Attorney, Agent, or Firm*—Buchanan Ingersoll & Rooney PC

(57) ABSTRACT

A golf club head, particularly for putting, includes a main body having a leading section and a trailing section where the leading section has a top edge and a bottom edge and the trailing section has a top edge and a bottom edge. A sole portion interconnects the bottom edge of the leading section and the bottom edge of the trailing section. A heel portion and a toe portion each include a weight disposed therein. In addition, a third weight is disposed in the trailing section of the club. The weighting is such that the moment of inertia of the club head is increased over known putters.

21 Claims, 3 Drawing Sheets

GOLF CLUB HEAD

FIELD OF THE INVENTION

The present invention generally relates to golf club heads. More particularly, the present invention pertains to a golf club putter head having an increased moment of inertia.

BACKGROUND DISCUSSION

In the game of golf, prior art golf club designs have attempted to improve the impact between a golf club and a golf ball. In particular, manufacturers of golf clubs have attempted to increase the moment of inertia of the club. The moment of inertia is a measure of the tendency of an object to resist rotational or twisting changes. To improve the directional accuracy of a swing, a high moment of inertia is desired, which will reduce the twisting change in the club when the ball is struck. This applies to all golf clubs, including putter heads.

Accuracy also depends on hitting the ball at a central area of the strike face, also known as the "sweet spot". When the ball is struck at the sweet spot, the putter head is prevented from twisting about the axis defined by the golf club shaft. However, when the sweet spot is missed, the inertia offered by the ball imparts a torque to the golf club shaft A putter head having a high moment of inertia resists the torque caused by missing the sweet spot. Putter heads having high moments of inertia are typically very wide and have weights attached to their outermost points. Most golfers prefer to play, however, with normal-sized, attractive putter heads such as blade-style putters, rather than over-sized putter heads. Blade-style putters have a relatively narrow or blade-like head.

The sweet spot of a club can be increased by appropriately weighting the club head. Typically, this is accomplished by way of heel/toe weighting. However, prior art weighting systems for putter heads have only yielded moments of inertia typically in the range of 3000 grams $cm^2$ to 4000 grams $cm^2$.

Thus, there is a need in the art for an attractive looking putter that has an increased moment of inertia.

SUMMARY

One exemplary embodiment of the golf club head of the present invention comprises a main body having a leading section and a trailing section. The leading section has a top edge and a bottom edge and the trailing section has a top edge and a bottom edge. A sole portion interconnects the bottom edge of the leading section and the bottom edge of the trailing section. A heel portion and a toe portion are disposed in the leading section. The heel portion includes a first weight-receiving cavity. A first weight is disposed in the first weight-receiving cavity. The toe portion includes a second weight-receiving cavity. A second weight is disposed in the second weight-receiving cavity. A third weight-receiving cavity is disposed in the trailing section of the club. A third weight is disposed in the third weight receiving cavity. A ratio of the weight of the third weight to the combined weight of the first and second weights is such that the moment of inertia of the club head is at least 5,000 grams-$cm^2$.

Another embodiment of the golf putter head of the present invention comprises a main body having a leading section and a trailing section. The leading section has a top edge and a bottom edge and the trailing section has a top edge and a bottom edge. A sole portion interconnects the bottom edge of the leading section and the bottom edge of the trailing section.

A heel portion and a toe portion are disposed in the leading section. The heel portion includes a first weight-receiving cavity. A first weight is disposed in the first weight-receiving cavity. The toe portion includes a second weight-receiving cavity. A second weight is disposed in the second weight-receiving cavity. A third weight-receiving cavity is disposed in the trailing section of the club. A third weight is disposed in the third weight receiving cavity. The heel and toe portion include a stepped down portion extending from the leading section to the trailing section. A web extends between the leading and trailing sections, the web being disposed normal to the sole portion.

Yet another embodiment of the golf putter head of the present invention comprises a main body having a leading section and a trailing section. The leading section has a top edge and a bottom edge and the trailing section has a top edge and a bottom edge. A sole portion interconnects the bottom edge of the leading section and the bottom edge of the trailing section. A heel portion and a toe portion are disposed in the leading section. The heel portion includes a first weight-receiving cavity. A first weight is disposed in the first weight-receiving cavity. The toe portion includes a second weight-receiving cavity. A second weight is disposed in the second weight-receiving cavity. A third weight-receiving cavity is disposed in the trailing section of the club. A third weight is disposed in the third weight receiving cavity and extends substantially through the trailing section. A web extends between the leading and trailing sections and is disposed normal to the sole portion.

Another embodiment of a golf club of the present invention comprises a putter head including a main body having a leading section and a trailing section. A shaft is connected to the main body. The leading section has a top edge and a bottom edge and the trailing section has a top edge and a bottom edge. A sole portion interconnects the bottom edge of the leading section and the bottom edge of the trailing section. A heel portion and a toe portion are disposed in the leading section. The heel portion includes a first weight-receiving cavity. A first weight is disposed in the first weight-receiving cavity. The toe portion includes a second weight-receiving cavity. A second weight is disposed in the second weight-receiving cavity. A third weight-receiving cavity is disposed in the trailing section of the club. A third weight is disposed in the third weight receiving cavity. A ratio of the weight of the third weight to the combined weight of the first and second weights is such that the moment of inertia of the club head is at least 5,000 grams-$cm^2$.

BRIEF DESCRIPTION OF THE DRAWING FIGURES

The accompanying drawings provide visual representations which will be used to more fully describe the representative embodiments disclosed herein and can be used by those skilled in the art to better understand them and their inherent advantages. In these drawings, like reference numerals identify corresponding elements.

DETAILED DESCRIPTION

Figure 1:
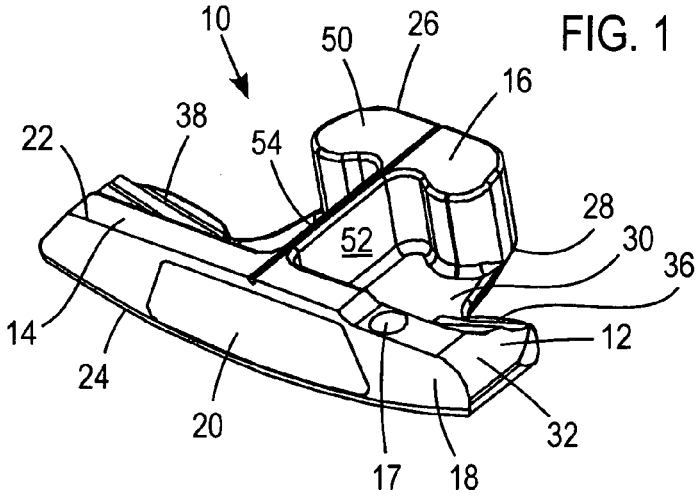
FIG. 1 illustrates a top perspective view an exemplary embodiment of the golf putter head of the present invention.
Figure 2:
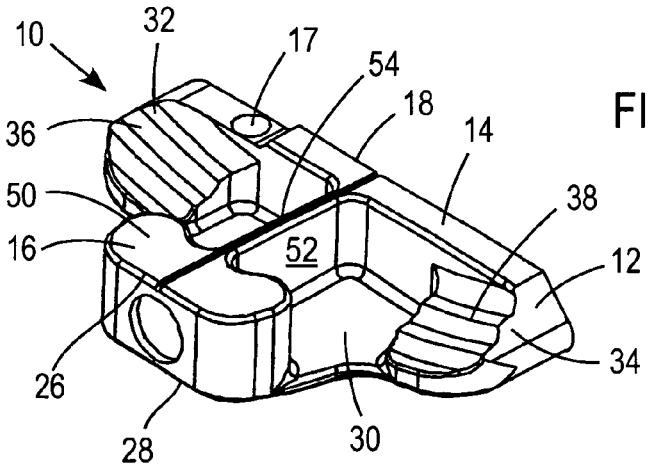
FIG. 2 illustrates a top perspective view of an exemplary embodiment of the golf putter head of the present invention.
Figure 3:
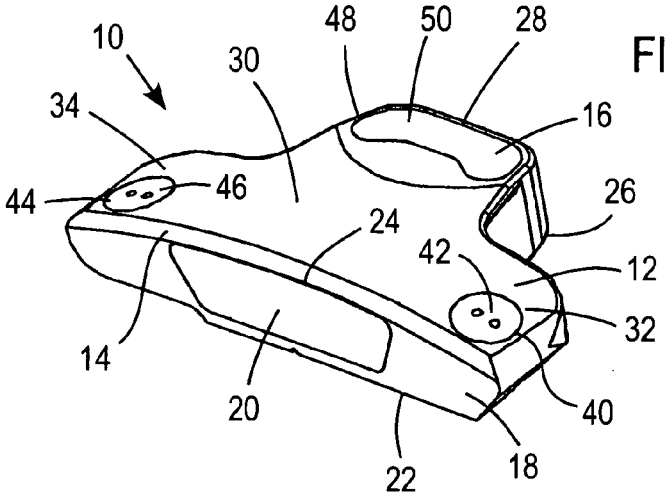
FIG. 3 illustrates a perspective view of the sole portion of an exemplary embodiment of the golf putter head of the present invention.

FIGS. 1-3 show one embodiment of a golf club head 10 of the present invention. While the golf club head 10 is generally described as suitable for use as a golf club head of a putter, it should be understood that it the golf club head according to the present invention is applicable to golf clubs other than a putter.

Golf club head 10 includes a main body 12 having a leading section 14 and a trailing section 16. The main body 12 includes a shaft receiving hole 17, in which a shaft is connected. Preferably, the main body 12 is made from 6061-T6 aluminum alloy. However, it should be understood that main body 12 may be made from other types of material such as magnesium.

The leading section 14 includes a front striking surface 18 for striking a golf ball. As shown in FIGS. 1 and 3, a ball-striking insert 20 may be mounted at the front striking surface 18. For example, an insert 20 made from a different material than the front striking surface 18 may be attached to the leading section 14 (e.g., positioned in a recess of the front of the leading section 14) and appropriately finished so as to be flush with the remainder of the front striking surface 18. In the preferred embodiment, the insert 20 is made from BeCu. However, it should be understood that the front striking surface 18 may be integrally formed, and/or made from one material.

The leading section 14 includes a top edge 22 and a bottom edge 24. Likewise, the trailing section 16 includes a top edge 26 and a bottom edge 28. A sole portion 30 interconnects the bottom edge 24 of the leading section 14 to the bottom edge 28 of the trailing section 16. Preferably, the sole portion 30 is a soleplate. However, it should be understood that sole portion 30 can be integrally formed as part of the main body 12.

A heel portion 32 and a toe portion 34 are provided in the leading section 14 of the club 10. Preferably, the heel portion 32 and toe portion 34 include a stepped down portion 36 and 38, respectively, extending from the leading section 14 towards the trailing section 16 of the club 10, as shown with reference to FIGS. 1 and 2. The stepped down portions 36 and 38, which each include a plurality of steps, create the appearance of a detached blade-type leading section 14, yet having the benefits of a non-blade type putter head, as described in more detail below. In addition, the shaft receiving hole 17 is included on the heel portion 32, which is slightly recessed from the top surface of the main body 12 as shown in FIGS. 1 and 2. However, it should be understood that the shaft may be placed at other locations on the club head 10, including but not limited to, the toe portion 34 or at the axis of symmetry of the club head 10.

With reference to FIG. 3, the heel portion 32 includes a first weight-receiving cavity 40 in which a first weight 42 is disposed. Similarly, the toe portion 34 includes a second weight-receiving cavity 44 in which a second weight 46 is disposed. Preferably, the first weight 42 and the second weight 46 are screw-threaded, weighing approximately 15 grams each. However, it should be understood that the first weight 42 and second weight 46 may weigh different amounts. In addition, the first weight 42 and second weight 46 may take forms other than a screw or screw-threaded member. The size or mass of the weights 42 and 46 may be increased or decreased to obtain the desirable weighting. Alternatively, the type of material chosen for the weights 42 and 46 can be appropriately chosen to effect the desirable weight. For example, the first and second weights 42 and 46 may be made from 6061-T6, copper, Cu/W (25/75), or tungsten, among other materials. In the preferred embodiment, the weights 42 and 46 are made from oxygen free copper (OFC).

A third weight receiving cavity 48 is disposed in the trailing section 16 of the club 10 in which a third weight 50 is disposed. Preferably, the third weight 50 is a bean shape, having portions increasing in dimension from the axis of symmetry of the club head 10, as shown in FIG. 3. In addition, the third weight preferably extends substantially through the trailing section 16.

The weight of the third weight 50 is strategically chosen to increase the moment of inertia of the club head 10. In particular, it was found that a large ratio of the weighting of the third weight 50 in comparison to the heel/toe weighting greatly increased the moment of inertia of the club head 10. In the preferred embodiment, the third weight is made from oxygen free copper, and weighs approximately 130 grams. The deep weighting in the rear of the club adds to the solidity of the putter with the weight being directly behind the ball during a putt, while also significantly increasing the moment of inertia. Preferably, the ratio of the weight of the third weight to the combined weight of the first and second weights is such that the moment of inertia of the putter head is at least 5000 grams-cm$^2$, preferably greater than 5500 grams-cm$^2$. For a club weighing 354 grams, having first and second weights 42 and 46 weighing 15 grams each and a third weight 50 weighing 130 grams, the moment of inertia was calculated to be approximately 5,609 grams-cm$^2$. For this example, the ratio of the third weight 50 to the combined weight of the first and second weights 42 and 46 is approximately 4 to 1.

The size or mass of the third weight 50 may be increased or decreased to obtain the desirable weighting. Alternatively, the type of material chosen for the third weight 50 can be appropriately chosen to effect the desirable weight or mass. For example, the third weight 50 may be made from 6061-T6, copper, Cu/W (25/75), or tungsten, among other materials. In the preferred embodiment, the third weight 50 is made from oxygen free copper (OFC).

With reference to FIGS. 1 and 2, the leading section 14 and the trailing section 16 are preferably connected by way of a web 52. The web 52 is disposed normal to the sole portion 30 along the axis of symmetry of the putter head 10. Preferably, the web 52 includes a sighting line 54 disposed thereon. In the illustrated embodiment, the web 52 is very narrow.

Figure 4:
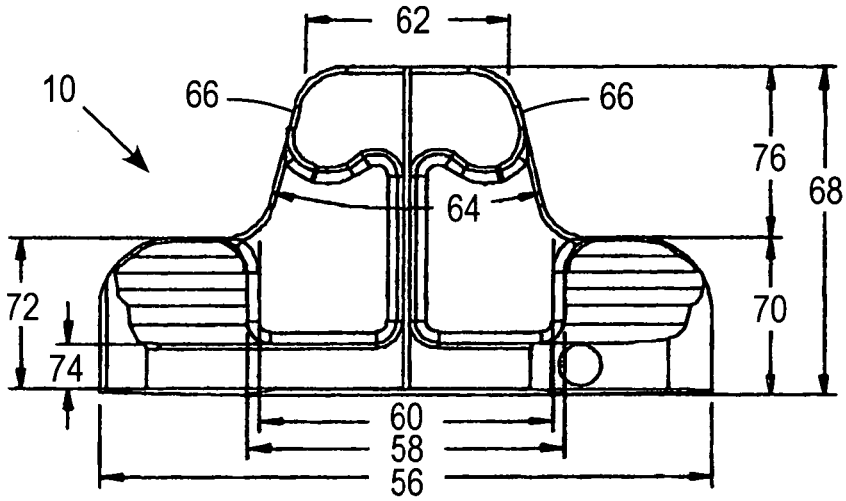
FIG. 4 illustrates a top plan view of an exemplary embodiment of the golf putter head of the present invention.
Figure 5:
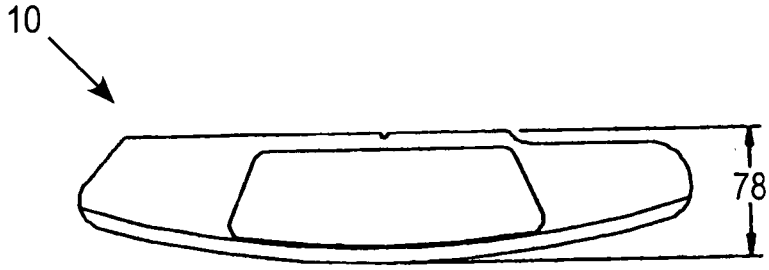
FIG. 5 illustrates a side elevational view of an exemplary embodiment of the golf putter head of the present invention.

With reference to FIGS. 4 and 5, the particular dimensions of the preferred putter head 10 will be described in more detail below. However, it should be understood that the dimensions described herein are only intended as examples, and may be modified to achieve desired results. With particular reference to FIG. 4, the length 56 of the leading section 14 of the club head 10 is between 5.0 inches-5.50 inches, preferably approximately 5.25 inches, while the length 58 between the top ends of the stepped down portions 36 and 38 is between 2.52 inches-2.92 inches, preferably approximately 2.72 inches and the length 60 between the bottom ends of the stepped down portions 36 and 38 is between 2.37 inches-2.67 inches, preferably approximately 2.52 inches. The length 62 of the trailing section 16 is between 1.56 inches-1.96 inches, preferably approximately 1.76 inches. The angle 64 between the side edges 66 of the trailing section 16 is between 23 degrees-33 degrees, preferably approximately 28 degrees.

The depth 68 of the club head 10 from the end of the leading section 14 to the end of the trailing section 16 is between 2.52 inches-3.32 inches, preferably approximately 2.92 inches, it being noted that the dimension 56 is greater than the dimension 68. Preferably, the leading section 14 has a slight loft, so that the depth 70 from bottom edge of the leading section 14 to the stepped portions 36 and 38 is between 1.22 inches-1.62 inches, preferably approximately 1.42 inches, while the depth 72 from the top edge of the leading section 14 to the stepped portions 36 and 38 is between 1.15 inches-1.55 inches, preferably approximately 1.35 inches. In addition, the depth 74 of the blade-like portion of the leading section 14 is between 0.30 inches-0.50 inches, preferably approximately 0.40 inches, and the distance 76 between the stepped down portions 36 and 38 and the end of the trailing section 16 is 1.30 inches-1.70 inches, preferably approximately 1.50 inches.

Figure 6:
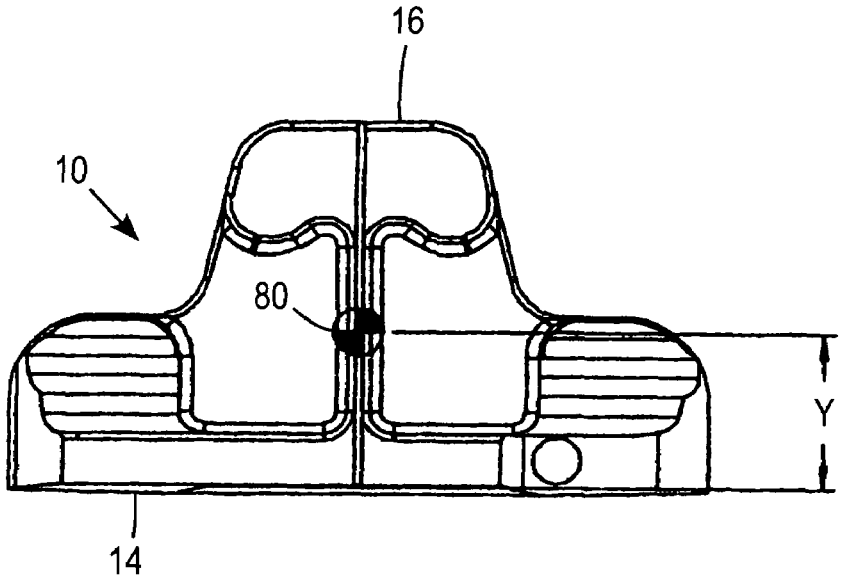
FIG. 6 illustrates a top plan view of an exemplary embodiment of the golf putter head of the present invention.
Figure 7:
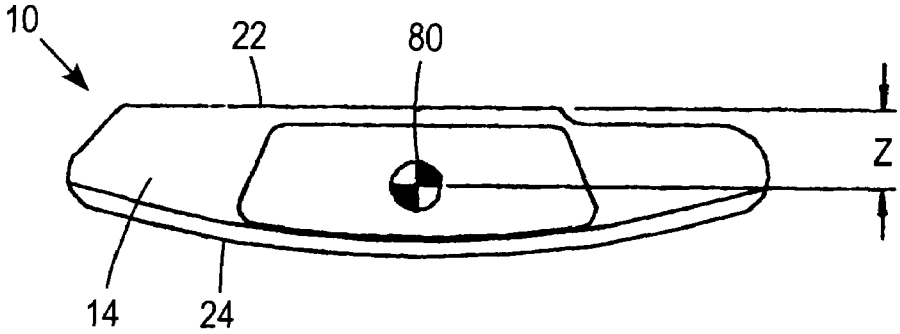
FIG. 7 illustrates a side elevational view of an exemplary embodiment of the golf putter head of the present invention.

With reference to FIG. 5, the thickness of the club head 10 from the top edge 22 of the leading section 14 to the bottom edge 24 of the leading section 14 is between 1.05 inches-1.25 inches, preferably approximately 1.15 inches. In accordance with the above-specified preferred dimensions, the center of gravity 80 was found to be at a distance Y measured from the end of the leading section 14, which was calculated to be 1.235 inches from the leading edge 14, as shown in FIG. 6. With reference to FIG. 7, the center of gravity 80 was found to be at a distance Z from a top edge 22 of the leading section 14, which was calculated to be 0.621 inches. Therefore, in accordance with the preferred embodiment, the center of gravity 80 is closer to the leading section 14 than the trailing section 16, and is disposed below the midpoint between the top and bottom edges 22 and 24 of the leading section 14. However, it should be understood that the center of gravity may be positioned at other locations on the club head, including at a location closer to the trailing section and/or closer to the top edge of the leading section.

The golf club head 10 of the present invention provides advantages over the art having a preferred blade-like appearance, yet having the benefits added by way of the deep weighting in the rear of the club, thereby achieving a balance between aesthetics and performance. In addition, the golf putter head 10 of the present invention has an increased moment of inertia not found in other blade-type putter heads.

The presently disclosed embodiments are considered in all respects to be illustrative and not restrictive. The scope is indicated by the appended claims, rather than the foregoing description, and all changes that come within the meaning and range of equivalents thereof are intended to be embraced.

What is claimed is:

1. A golf putter head, comprising:

a main body having a leading section and a trailing section, said leading section having a top edge and a bottom edge and said trailing section having a top edge and a bottom edge;

a sole plate interconnecting only said bottom edge of said leading section and said bottom edge of said trailing section such that a void is defined between said leading section and said trailing section in a longitudinal direction;

a web disposed centrally within the void so as to bifurcate the same and further interconnecting said leading and trailing sections, said web being disposed normal to the sole plate and including a sighting line disposed thereon;

a heel portion and a toe portion disposed in the leading section;

a first weight-receiving cavity formed in said heel portion;

a first weight positioned within said first weight-receiving cavity;

a second weight-receiving cavity formed in said toe portion;

a second weight positioned within said second weight-receiving cavity;

a third weight-receiving cavity formed in said trailing section;

a third weight positioned within said third weight-receiving cavity;

whereby a ratio of the weight of the third weight to the combined weight of the first and second weights is such that the moment of inertia of the putter head is at least 5,000 grams-cm$^2$.

2. The golf putter head of claim 1, wherein a center of gravity is closer to the leading section than the trailing section.

3. The golf putter head of claim 1, wherein the first and second weights weigh approximately 15 grams each and the third weight weighs approximately 130 grams.

4. The golf putter head of claim 1, wherein the third weight extends substantially through the trailing section.

5. The golf putter head of claim 1, wherein the ratio of the weight of the third weight to the combined weight of the first and second weights is at least 4 to 1.

6. The golf putter head of claim 1, wherein the moment of inertia is greater than 5500 grams-cm$^2$.

7. A golf putter head, comprising:

a main body having a leading section and a trailing section, said leading section having a top edge and a bottom edge and said trailing section having a top edge and a bottom edge;

a sole interconnecting only said bottom edge of said leading section and said bottom edge of said trailing section such that a void is defined between said leading section and said trailing section in a longitudinal direction;

a heel portion and a toe portion disposed in the leading section, said heel portion and toe portion including a stepped down portion extending within the void from the leading section to the trailing section;

a first weight-receiving cavity formed in said heel portion;

a first weight positioned within said first weight-receiving cavity;

a second weight-receiving cavity formed in said toe portion;

a second weight positioned within said second weight-receiving cavity;

a third weight-receiving cavity formed in said trailing section;

a third weight positioned within said third weight-receiving cavity; and a web disposed within said void so as to bifurcate the same, said web extending between the leading and trailing sections, said web being disposed normal to the sole plate.

8. The golf putter head of claim 7, wherein a ratio of the weight of the third weight to the combined weight of the first and second weights is such that the moment of inertia of the putter head is at least 5,000 grams-cm$^2$.

9. The golf putter head of claim 7, wherein said web includes a sighting line disposed thereon.

10. The golf putter head of claim 7, wherein the first and second weights weigh approximately 15 grams each and the third weight weighs approximately 130 grams.

11. The golf putter head of claim 7, wherein the ratio of the weight of the third weight to the combined weight of the first and second weights is at least 4 to 1.

12. The golf putter head of claim 7, wherein the moment of inertia is greater than 5500 grams-cm$^2$.

13. The golf putter head of claim 7, wherein the third weight extends substantially through the trailing section.

14. The golf putter head of claim 7, wherein a center of gravity is closer to the leading section than the trailing section.

15. The golf putter head of claim 7, wherein the ratio of the weight of the third weight to the combined weight of the first and second weights is at least 4 to 1.

16. The golf putter head of claim 7, wherein the moment of inertia is greater than 5500 grams-$cm^2$.

17. The golf putter head of claim 7, wherein a center of gravity is closer to the leading section than the trailing section.

18. A golf putter head, comprising:

a main body having a leading section and a trailing section, said leading section having a top edge and a bottom edge and said trailing section having a top edge and a bottom edge;

a sole plate interconnecting only said bottom edge of said leading section and said bottom edge of said trailing section such that a void is defined between said leading section and said trailing section in a longitudinal direction;

a heel portion and a toe portion disposed in said leading section;

a first weight-receiving cavity formed in said heel portion;

a first weight positioned within said first weight-receiving cavity;

a second weight-receiving cavity formed in said toe portion;

a second weight positioned within said second weight-receiving cavity;

a third weight-receiving cavity formed in said trailing section;

a third weight positioned within said third weight-receiving cavity and extending substantially through the trailing section, said leading section and said trailing section having substantially the same depth; and a web disposed within said void so as to bifurcate the same, said web extending between the leading and trailing sections, said web being disposed normal to the sole plate.

19. The golf putter head of claim 18, wherein a ratio of the weight of the third weight to the combined weight of the first and second weights is such that the moment of inertia of the putter head is at least 5,000 grams-$cm^2$.

20. The golf putter head of claim 18, wherein said web includes a sighting line disposed thereon.

21. The golf putter head of claim 18, wherein the first and second weights weigh approximately 15 grams each and the third weight weighs approximately 130 grams.

* * * * *